United States Patent [19]

Potthoff et al.

[11] 3,987,845

[45] Oct. 26, 1976

[54] AIR-COOLING TOWER

[75] Inventors: Robert Edward Potthoff, La Jolla; Herman Peter Fay, Solana Beach, both of Calif.

[73] Assignee: General Atomic Company, San Diego, Calif.

[22] Filed: Mar. 17, 1975

[21] Appl. No.: 558,698

[52] U.S. Cl. ..... 165/129; 261/DIG. 11

[51] Int. Cl.[2] ..... B01F 3/04; F24H 9/02

[58] Field of Search ..... 261/DIG. 11, 39 R, 109; 165/110, 111, 122

[56] References Cited

UNITED STATES PATENTS

| | | | |
|---|---|---|---|
| 3,846,519 | 11/1974 | Spangemacher | 261/109 |
| 3,903,212 | 9/1975 | Lefevre | 261/DIG. 11 |

FOREIGN PATENTS OR APPLICATIONS

| | | | |
|---|---|---|---|
| 974,691 | 11/1964 | United Kingdom | 165/129 |

*Primary Examiner*—Charles J. Myhre
*Assistant Examiner*—Theophil W. Streule, Jr.
*Attorney, Agent, or Firm*—Fitch, Even, Tabin & Luedeka

[57] ABSTRACT

A cooling tower is described employing a heat exchanger and duct means defining a passage for directing the air over the heat exchanger for cooling same. The duct means have upper and lower air intake orifices, the former being positioned a substantial distance above ground level and the latter being positioned substantially at ground level. Means are provided for selectively drawing air into the duct means through either of said orifices.

7 Claims, 5 Drawing Figures

AIR-COOLING TOWER

This invention relates generally to cooling towers and, more particularly, to an improved cooling tower capable of taking advantage of variations in the adiabatic lapse rate near ground level.

Cooling towers are often employed in connection with various kinds of industrial or power generating equipment. For example, a cooling tower may be employed in a closed cycle gas turbine system for the purpose of cooling the gas prior to compression.

Typically, a dry-cooling tower employs suitable heat exchange structure such as tubes or similar conduits arranged to provide an interface between the material being cooled and flowing air. A wet cooling tower may employ means to facilitate evaporation of a coolant liquid. In either case, air may be caused to flow by natural convection or may be caused to flow in forced air systems by fans. For the purpose of directing the air through the heat exchanger, the heat exchanger is enclosed in a duct system of suitable shape. For example, one particularly useful duct system includes a main duct comprising an open top funnel in which the heat exchanger is placed. The warming effect of the heat exchanger on the air results in an natural convection flow of air upwardly through the funnel, drawing additional air inwardly near the bottom of the funnel through an annular intake region.

The rate of variation in the temperature of the atmosphere with distance above the ground is generally referred to as the adiabatic lapse rate. Ideally, this involves a substantially linear decline in temperature with distance above the ground, typically several degrees Fahrenheit per thousand feet.

During mid-day, solar heating from the sun heats the ground to a temperature higher than the air above the ground. By convection, the hot ground heats the air immediately above the ground to a temperature above the normal adiabatic lapse rate temperatures. This effect is particularly pronounced in summer during mid-day in barren, semi-arid or desert areas where cover is minimal. At night, the above described super-adiabatic lapse rate effect frequently reverses and becomes sub-adiabatic. The ground cools by radiation to the night sky to a temperature lower than the air just above the ground. This means that the air a substantial distance above the ground may actually be warmer than that at the surface, and that the coolest air available for a heat exchanger frequently is at ground level at night, whereas it is above ground level during the hot part of the day.

It is an object of the present invention to provide an improved cooling tower.

Another object of the invention is to provide a cooling tower capable of utilizing the effect of the super-adiabatic or sub-adiabatic lapse rate at ground level.

Another object of the invention is to provide a cooling tower in which the coolest possible air is supplied to the heat exchanger under all operating conditions.

Various other objects of the invention will become apparent to those skilled in the art from the foregoing description, taken in connection with the accompanying drawings wherein.

Figure 1:
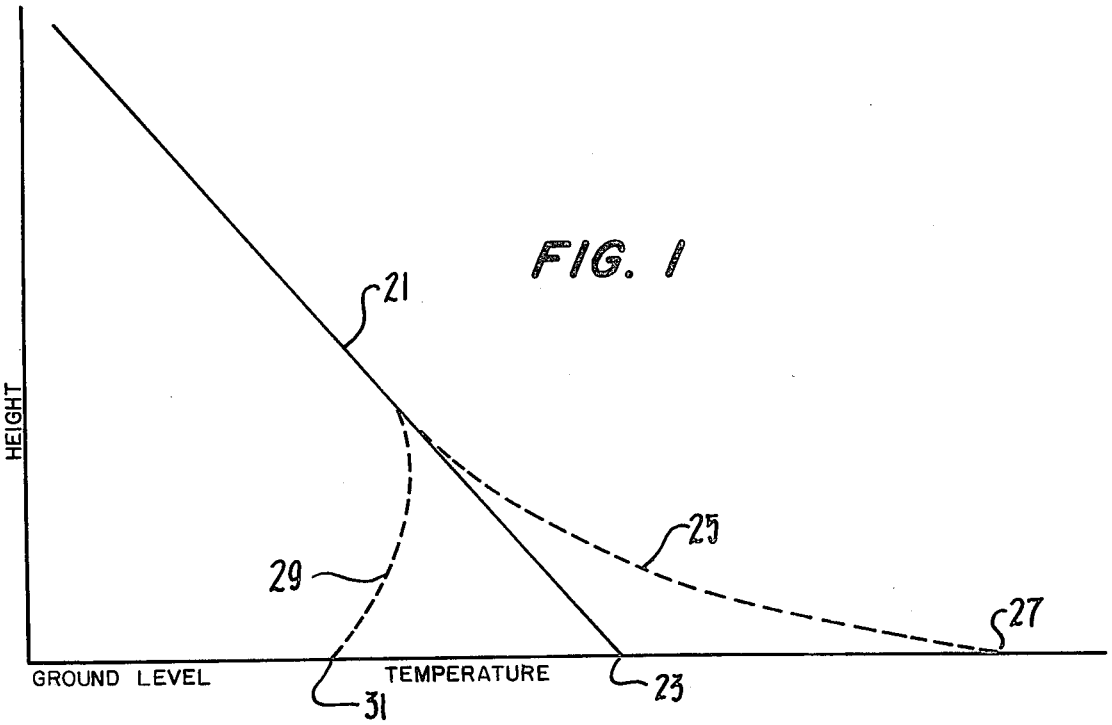
FIG. 1 is a graph illustrating the variation in air temperature versus height above the ground and illustrating the variation in adiabatic lapse rate which may occur at a typical cooling tower location.

Very generally, the cooling tower of the invention comprises a heat exchanger 11 and duct means 12 defining a passage for directing air over the heat exchanger for cooling same. The duct means include an upper air intake orifice 13 positioned a substantial distance above ground level 14. The duct means further include a lower air intake orifice 15 positioned substantially at ground level. Means 16 are provided for selectively drawing air into the duct means through the upper air intake orifice or through the lower air intake orifice.

Referring now more particularly to FIG. 1, a graph is presented in which air temperature is plotted versus height above ground level. The line 21 represents the normal adiabatic lapse rate which is approximately 4° F per 1000 feet. If this line 21 is extrapolated to ground level, the air temperature at ground level is thereby represented at the point 23. During mid-day as one approaches ground level, the rate of temperature rise increases greatly at a super-adiabatic rate as shown by the dotted line 25 to the right of thhe solid line 21. The temperature at ground level during mid-day is thereby represented by the point 27, the difference in temperature between the points 23 and 27 thereby representing the effect of ground heating at mid-day. At night, the adiabatic lapse rate frequently reverses as illustrated by the dotted line 29 to the left of the solid line 21 in FIG. 1. The line 29 intersects the gound level at the point 31 and the difference between the temperature at the point 23 and the temperature at the point 31 represents the effect of ground cooling during the night time.

Figure 2:
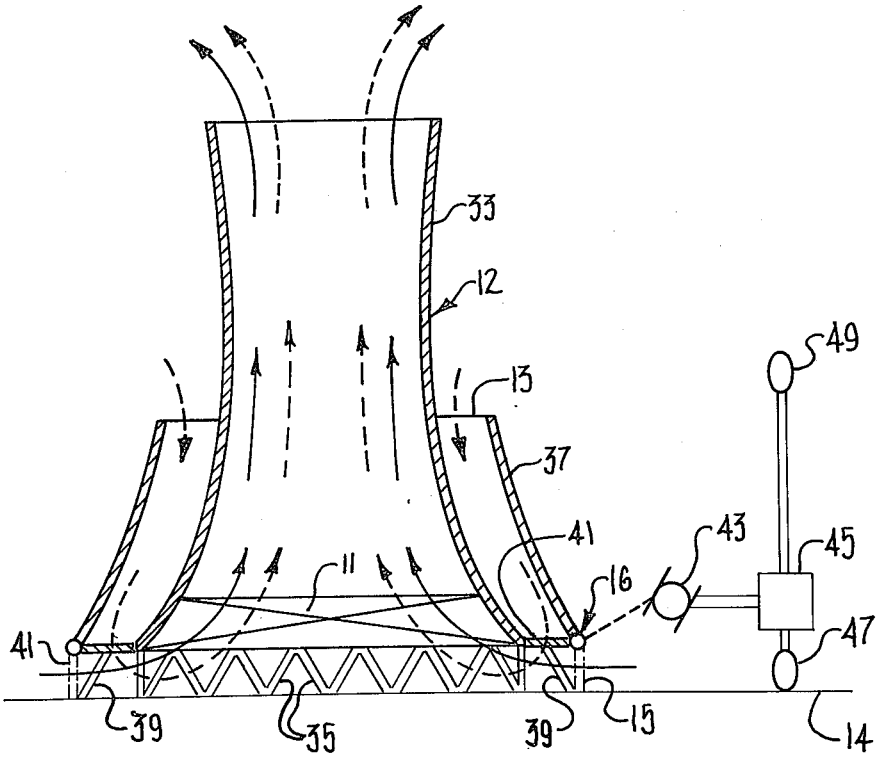
FIG. 2 is a schematic full section view illustrating a dry-cooling tower constructed in accordance with the invention.

Referring now more particularly to FIG. 2, a dry-cooling tower constructed in accordance with the invention is shown which is capable of taking advantage of the variations described above to minimize the temperature of the air flowing through the heat exchanger. More particularly, the cooling tower includes a heat exchanger which is of suitable configuration depending upon the particular fluid being cooled and depending upon the particular operating temperatures desired. The heat exchanger 11 may therefore consist of a plurality of tubes or similar conduits arrayed in loops or convolutions to provide the desired heat exchange surface.

For the purpose of confining the flowing cooling air to the heat exchanger 11, the duct means 12 include a funnel 33, the upper and lower ends of which are open. Air is drawn in through the open lower end of the funnel 33 and exits through the open top end of the funnel 33 as indicated by the solid line arrows and by the dotted line arrows. The funnel 33 is supported slightly above ground level by a plurality of struts 35 which thereby form an annular intake region just above the ground level 14.

In the embodiment illustrated in FIG. 2, the duct means 12 further include an annular sleeve 37, which is supported by suitable struts 39, surrounding the funnel 33 coaxially thereof. The sleeve 37 is shaped in a flared configuration to match the configuration of the funnel 33 which it surrounds. The axial length of the sleeve 37 is substantially less than the axial length of the funnel 33 to prevent recycling of the air discharged from the top of the funnel, as described in greater detail below.

Means 16 are provided for selectively drawing air into the duct means through either the upper annular opening 13 between the sleeve 37 and the funnel 33 or through the annular opening 15 between the lower edge of the sleeve 37 and the ground 14. The means 16 include a movable valve or gate 41 of suitable configuration and which is capable of moving from the position shown by the solid lines (in which the annulus formed between the lower edge of the sleeve 37 and the lower edge of the funnel 33 is closed) to the position shown by the dotted lines (in which opening 15 is closed and the previously described annulus is open). Movement is effected by a suitable electric motor 43 controlled by a motor drive control 45.

The motor drive control is connected to a temperature sensor 47 and to a temperature sensor 49. The temperature sensor 47 is positioned at ground level and the temperature sensor 49 is positioned at the level of the air intake 13. When the motor control unit 45 senses that the temperature at the temperature sensor 47 is greater than that at the temperature sensor 49, the valve element 41 is moved to the position shown by the dotted lines. In this case, the air drawn into the duct means through the opening 13 passes down through the region between the sleeve 37 and the funnel 33, around beneath the lower edge of the funnel 33 as shown by the dotted arrows, and then up through the funnel 33 past the heat exchanger 11, being discharged from the open top of the funnel.

When the temperature sensed by the temperature sensors 47 and 49 indicates that the temperature at ground level 14 is lower, the motor control unit 45 causes the motor 43 to move the valve element 41 to the position shown by the solid lines. As shown by the solid lines, air then enters the duct means 12 through the opening 15, passing beneath the lower edge of the funnel 33 and up through the funnel over the heat exchanger to be discharged through the open top.

Figure 3:
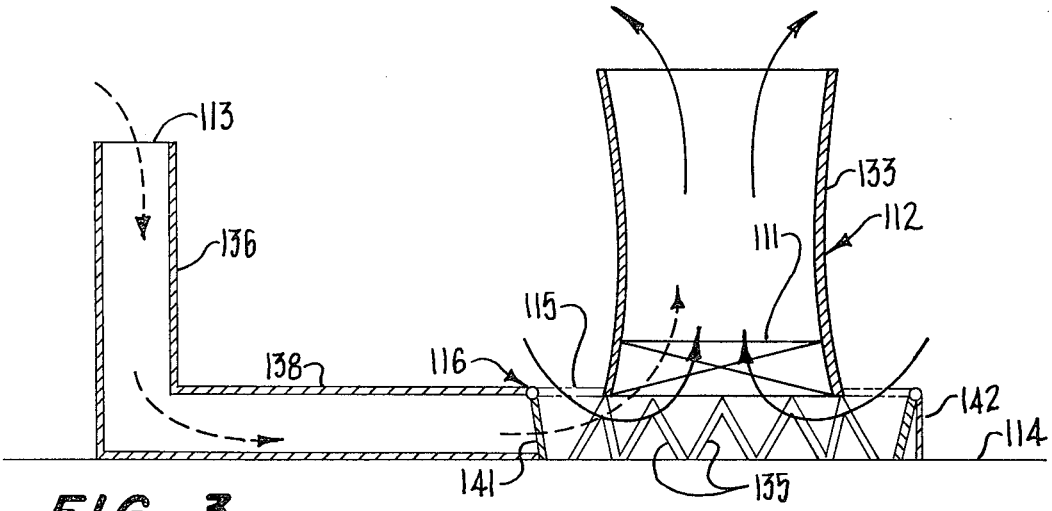
FIG. 3 is a full section schematic view illustrating a further embodiment of the invention.

Referring now to FIG. 3, a further embodiment of the invention is illustrated. Those parts of the embodiment of FIG. 3 which are similar in function and structure to parts in the embodiment of FIG. 2 have been given identical reference numbers preceded by a 1.

The cooling tower of FIG. 3 is of the natural convection type employing an open top funnel 133 as part of the duct means 112 enclosing the heat exchanger 111. To simplify the drawing, the motor, motor control and temperature sensors are not illustrated in FIG. 3 but it is to be understood that they may be employed.

In the embodiment shown in FIG. 3, the upper air inlet opening 113 is formed at the top of a stack 136 which is in communication with the annular space beneath the lower edge of the funnel 133 by a conduit 138.

The conduit 138 terminates in an annulus 142 which surrounds the annular space beneath the lower edge of the funnel 133 and the ground 114. The valve means 141 are of a suitable configuration such that, in the position illustrated in solid lines, the conduit 138 is blocked at the end thereof adjacent the annulus 142. The annulus 142 is of relatively short axial length and, when the valve means 141 are in the position illustrated in the solid lines, the top of the annulus is open so that air may be drawn therein from adjacent ground level as illustrated by the solid arrows.

When the air is cooler a substantial distance above ground level, the valve means 141 are adjusted such that the conduit 138 communicates with the annulus 142 and such that the upper portion of the annulus 142 is closed as indicated by the dotted lines in FIG. 3. In this condition, air is drawn into the funnel 133 through the orifice 113, stack 136 and the conduit 138, as illustrated by the dotted arrows. Thus, the air flowing over the heat exchanger 111 is drawn from a position substantially higher than ground level.

More than one inlet stack may be used, thus insuring that at least one of the stacks may be positioned upwind of the hot exhaust air emanating from the top of the funnel 133 and therefore will always provide a cool inlet supply. Suitable regulation of the dual stacks may then be effected to insure there is no short circuiting of the hot exhaust air. Naturally, the stacks are placed a distance from the funnel 133 sufficient to avoid interaction with the hot exhaust air by the upwind stack.

Figure 4:
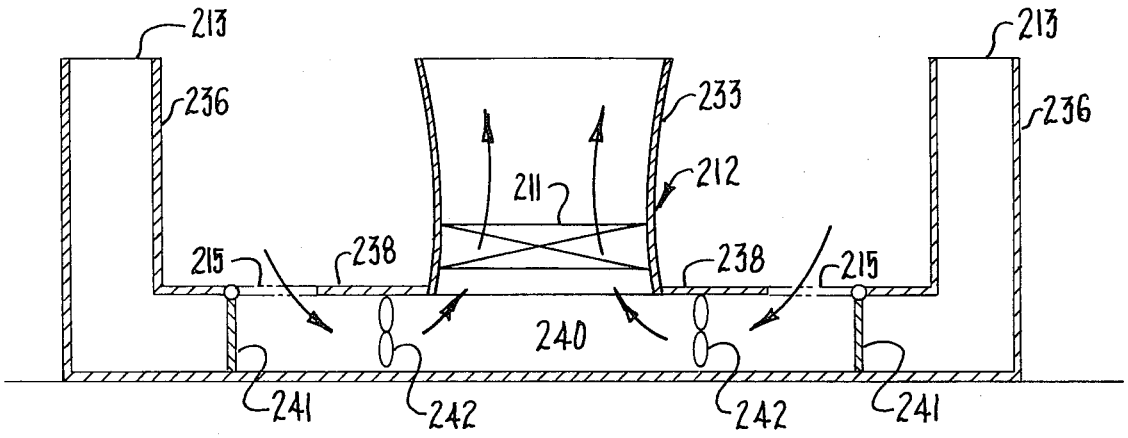
FIG. 4 is a full section schematic view illustrating a still further embodiment of the invention.

In FIG. 4, a forced air convection cooling tower is illustrated in which the means for selectively drawing air into the duct means through the upper or lower air intake orifices include both valve means 241 and fans 242. Instead of being positioned as shown, a single fan could be placed in the funnel 233 itself. The other elements of the cooling tower illustrated in FIG. 4 which are similar in design and function to elements in FIG. 2 have been given identical reference numbers preceded by a 2.

In the illustrated embodiment, two ducts 238 communicate with a plenum 240 beneath the heat exchanger 211. Stacks 236 are provided defining upper air inlet openings 213 positioned a substantial distance above the ground and which are spaced a sufficient distance from the open top of the funnel 233 so as to avoid interference with the hot exhaust air. The lower air inlet openings are formed in the conduits 238 as illustrated at 215. With the valve means shown in the position illustrated in solid lines, rotation of the fans 242 causes air to be drawn in through the lower air inlet openings 215 and into the plenum 240. From there it passes upwardly through the heat exchanger 211 to be discharged from the open top of the funnel 233.

When the valve means 241 are moved to the position shown by the dotted lines, thus closing the lower air intake orifices 215, the ducts 238 communicate with the stacks 236. Operation of the fans 242 therefore serves to draw the intake air through the upper air intake orifices 213, conveying it to the plenum 240 from whence it passes upwardly through the heat exchanger 211.

As was the case in the embodiment of FIG. 3, the stacks 236 are positioned a sufficient distance from the discharged air so as to avoid interaction therewith. The use of two or more stacks insures that at least one of the stacks will be positioned upwind from the hot exhaust air. Suitable temperature sensors, motor controls and motor drive circuits for the fans and the valve means may be provided, but are not illustrated for simplicity.

Figure 5:
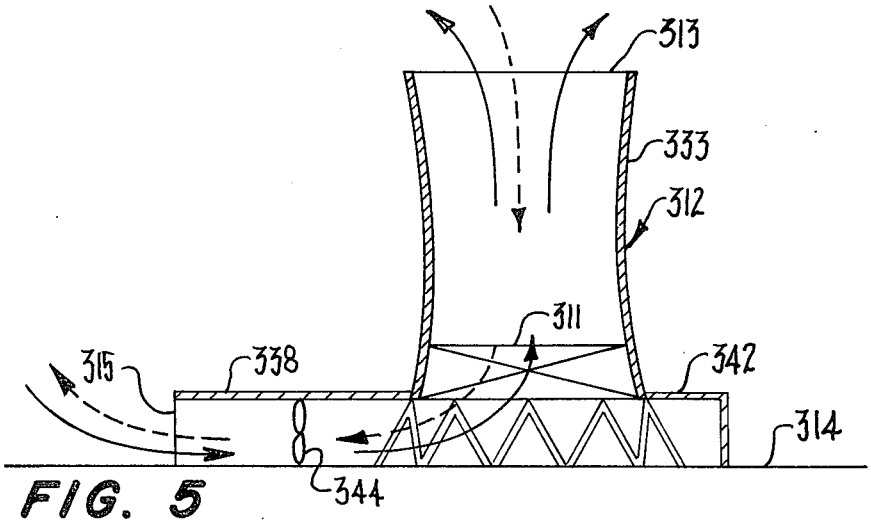
FIG. 5 is a full section schematic view illustrating still another embodiment of the invention.

In FIG. 5, a cooling tower constructed in accordance with the invention is shown in which the flow of air is reversed for day and night operations. Parts in the embodiment of FIG. 5 having a configuration and function similar to those of the embodiment of FIG. 2 have been given identical reference numbers preceded by a 3. In the embodiment of FIG. 5, the duct means 312 consist of the funnel 333 and a horizontal conduit 338. The conduit 338 terminates in an annulus 342 which surrounds the space between the ground 314 and the lower edge of the funnel 333. The top of the annulus 342 is closed and a fan is provided in the duct or conduit 338. Alternatively, the fan could be placed in the funnel 333 itself. The fan is a reversible fan and is suitably controlled by a motor, motor control circuit, and temperature sensors, not illustrated. The terminus of the conduit 338 furthest from the heat exchanger 311 forms the lower air intake orifice 315. The upper air intake orifice 313 is defined by the open top of the funnel 333.

Assuming the temperature sensors, not shown, indicate that cooler air is at ground level, the fans 344 rotate in a direction to force air as indicated by the solid arrows. Thus, air is drawn in through the lower air intake orifice 315 and passes upwardly through the funnel 333 to be discharged at the open top end thereof. In this case, the upper air intake orifice serves as a discharge orifice.

When the temperature sensors indicate that the temperature of the air a substantial distance above ground level is cooler than the air at ground level, the direction of rotation of the fan 344 is reversed. This draws air through the upper air intake orifice 313 as indicated by the dotted arrows. This air passes downwardly over the heat exchanger 311 and through the conduit 338 to be discharged therefrom through what was formerly the lower intake orifice 315. Suitable baffles or other ducting configurations may be employed to prevent hot exhaust air from mixing back into the inlet. As an alternative to reversing the fan, the direction of air flow could be reversed by suitable ducting and valves at the fan.

The distance above the ground at which the upper air intake orifice is placed in all cases is determined by accumulating specific data on the lapse rate effect with respect to the particular temperature-height profile of the cooling tower and its specific physical geographical location. Such data is dependent upon site location and time of day and year and may be affected by the heat exchanger's total load. It is conceivable that the air flow provided in the cooling tower is of such a magnitude that the adiabatic lapse rate temperature profile may be altered by the cooling tower itself. That is, hot ground air may be swept away so fast that cooler air from above the ground becomes available at ground level. If such is the case, the level of the upper air intake orifice may be closer to the ground than otherwise. To further minimize the daytime effect of the super-adiabatic lapse rate, the ground surface surrounding the cooling tower may be covered with vegetation or a reflective material such as white crushed rock. This will reduce heat absorption by the ground and subsequent heating of the cooling tower intake air.

It may be seen, therefore, that the invention provides an improved performance cooling tower capable of utilizing the effect of variations in the adiabatic lapse rate adjacent the ground. More particularly, the cooling tower of the invention avoids the intake of hot air adjacent the ground surface usually present at mid-day, while at the same time is capable of utilizing the relatively cooler air present at ground level during the night-time. Thus, greater cooling efficiency may be achieved on a 24-hour basis.

Various modifications of the invention in addition to those shown and described herein will become apparent to those skilled in the art from the foregoing description and accompanying drawings. Such modifications are inteded to fall within the scope of the appended claims.

What is claimed is:

1. A cooling tower comprising, a heat exchanger, duct means defining a passage for directing air over said heat exchanger for cooling same, said duct means having an upper air intake orifice positioned a substantial distance above ground level and having a lower air intake orifice positioned substantially at ground level so that said upper and lower air intake orifices are vertically positioned apart sufficient to make air available adjacent the upper and lower air intake orifices, and means for selectively drawing air into said duct means through either one of said upper air intake orifice or said lower air intake orifice.

2. A cooling tower according to claim 1 wherein said drawing means comprise movable valve means capable of opening one of the upper and lower air intake orifices to the duct means and effectively closing the other of the orifices from the duct means.

3. A cooling tower according to claim 1 wherein said drawing means comprise fan means.

4. A cooling tower according to claim 1 including temperature sensing means for sensing the air temperature at the level of each of said upper and lower air intake orifices, and means responsive to said temperature sensing means for operating said drawing means such that air will be drawn through the one of said air intake orifices at which the temperature is the lower.

5. A cooling tower according to claim 1 wherein said duct means include an open top funnel having an annular intake region at ground level, and ancillary duct means communicating therewith, said ancillary duct means comprising a sleeve surrounding at least a portion of said funnel coaxially thereof.

6. A cooling tower according to claim 1 wherein said duct means include an open top funnel having an annular intake region at ground level, and ancillary duct means communicating therewith, said ancillary duct means comprising at least one stack displaced from said funnel, the upper end of which forms said upper intake orifice.

7. A cooling tower according to claim 1 wherein said duct means include an open top funnel having an annular intake region at ground level, and ancillary duct means communicating therewith, said drawing means comprising reversible fan means positioned in said ancillary duct means for directing the flow of air through said duct means in either direction.

* * * * *